US008128760B2

(12) United States Patent
Nagata et al.

(10) Patent No.: US 8,128,760 B2
(45) Date of Patent: Mar. 6, 2012

(54) PERMANENT MAGNET AND METHOD OF MANUFACTURING SAME

(75) Inventors: Hiroshi Nagata, Ibaraki (JP); Kyuzo Nakamura, Kanagawa (JP); Takeo Katou, Kanagawa (JP); Atsushi Nakatsuka, Kanagawa (JP); Ichirou Mukae, Kanagawa (JP); Masami Itou, Kanagawa (JP); Ryou Yoshiizumi, Kanagawa (JP); Yoshinori Shingaki, Ibaraki (JP)

(73) Assignee: Ulvac, Inc., Kanagawa (JP)

( * ) Notice: Subject to any disclaimer, the term of this patent is extended or adjusted under 35 U.S.C. 154(b) by 321 days.

(21) Appl. No.: 12/519,884

(22) PCT Filed: Dec. 19, 2007

(86) PCT No.: PCT/JP2007/077406

§ 371 (c)(1),
(2), (4) Date: Jul. 30, 2009

(87) PCT Pub. No.: WO2008/075711

PCT Pub. Date: Jun. 26, 2008

(65) Prior Publication Data

US 2011/0001593 A1 Jan. 6, 2011

(30) Foreign Application Priority Data

Dec. 21, 2006 (JP) ..... 2006-344781

(51) Int. Cl.
*H01F 1/057* (2006.01)

(52) U.S. Cl. ..... 148/122; 148/302

(58) Field of Classification Search ..... None
See application file for complete search history.

(56) References Cited

U.S. PATENT DOCUMENTS

2006/0213583 A1 9/2006 Nakamura et al.
2006/0278517 A1 12/2006 Machida et al.
2007/0017601 A1* 1/2007 Miyata et al. ..... 148/105
2008/0245442 A1* 10/2008 Nakamura et al. ..... 148/101
2009/0322459 A1* 12/2009 Nagata et al. ..... 335/302
2010/0164663 A1* 7/2010 Nagata et al. ..... 335/302

FOREIGN PATENT DOCUMENTS

EP 1 643 513 A1 * 4/2006

(Continued)

OTHER PUBLICATIONS

Japanese Foreign Priority Document Japan 2006-344781 Dec. 21, 2006.*

(Continued)

*Primary Examiner* — John Sheehan
(74) *Attorney, Agent, or Firm* — Cermak Nakajima LLP; Tomoko Nakajima

(57) ABSTRACT

By eliminating the necessity of a prior step for cleaning a sintered magnet before adhering Dy and/or Tb to the surface of the sintered magnet S, the productivity of a permanent magnet having diffused Dy and/or Tb into grain boundary phase is improved. Iron-boron-rare earth based sintered magnet (S) disposed in a processing chamber (20) is heated to a predetermined temperature. An evaporating material (V) which is made of a hydride containing at least one of Dy and Tb is disposed in the same or in another processing chamber and is evaporated to cause the evaporated evaporating material to the surface of the sintered magnet. Metal atoms of Dy and/or Tb are diffused into grain boundary phase of the sintered magnet.

8 Claims, 4 Drawing Sheets

| | Evaporating source | Vapor Processing Time(h) | Br(kG) | iHc(k0e) | (BH)max(MG0e) | (BH)max+iHc |
|---|---|---|---|---|---|---|
| Compar-ative Example 1a | No | 0 | 13.6 | 15.8 | 44.7 | 60.5 |
| | Dy | 1 | 13.6 | 18.9 | 45.1 | 64.0 |
| | Dy | 8 | 13.6 | 20.5 | 45.0 | 65.5 |
| | Dy | 18 | 13.6 | 24.3 | 44.7 | 69.0 |
| Example 1a | DyH2 | 1 | 13.6 | 20.9 | 45.0 | 65.9 |
| | DyH2 | 8 | 13.6 | 24.3 | 45.1 | 69.4 |
| | DyH2 | 18 | 13.6 | 24.2 | 45.1 | 69.3 |

FOREIGN PATENT DOCUMENTS

| | | |
|---|---|---|
| JP | 2005-175138 | 6/2005 |
| JP | 2006-303433 | 11/2006 |
| WO | W02006/100968 | 9/2006 |

OTHER PUBLICATIONS

Kite, P., "Improvement of coercivity on thin Nd2Fe14B sintered permanent magnets," Mar. 23, 2000, Tohoku University, Doctor Thesis.

International Search Report for PCT Patent App. No. PCT/JP2007/074406 (Mar. 18, 2008).

Yu. M. Lahtin, B. N. Arzamasov "Thermo-Chemical Treatment of Metals" Moscow, Metallurgy, 1985, pp. 29 and 208, Fig. 144.

Official Action from Russian Patent App. No. 2009128025 issued Oct. 12, 2011 with English language translation thereof.

* cited by examiner

FIG.5

| | Evaporating source | Vapor Processing Time(h) | Br(kG) | iHc(k0e) | (BH)max(MG0e) | (BH)max+iHc |
|---|---|---|---|---|---|---|
| Compar -ative Example 1a | No | 0 | 13.6 | 15.8 | 44.7 | 60.5 |
| | Dy | 1 | 13.6 | 18.9 | 45.1 | 64.0 |
| | Dy | 8 | 13.6 | 20.5 | 45.0 | 65.5 |
| | Dy | 18 | 13.6 | 24.3 | 44.7 | 69.0 |
| Example 1a | DyH2 | 1 | 13.6 | 20.9 | 45.0 | 65.9 |
| | DyH2 | 8 | 13.6 | 24.3 | 45.1 | 69.4 |
| | DyH2 | 18 | 13.6 | 24.2 | 45.1 | 69.3 |

FIG.6

| | Evaporating source | Vapor Processing Time(h) | Br(kG) | iHc(k0e) | (BH)max(MG0e) | (BH)max+iHc |
|---|---|---|---|---|---|---|
| Compar -ative Example 1b | No | 0 | 13.6 | 15.8 | 44.7 | 60.5 |
| | Tb | 1 | 13.6 | 20.9 | 45.2 | 66.1 |
| | Tb | 7 | 13.6 | 23.5 | 45.2 | 68.7 |
| | Tb | 18 | 13.6 | 28.3 | 45.1 | 73.4 |
| Example 1b | TbH2 | 1 | 13.6 | 25.3 | 45.1 | 70.4 |
| | TbH2 | 7 | 13.6 | 28.2 | 45.0 | 73.2 |
| | TbH2 | 18 | 13.6 | 28.4 | 45 | 73.4 |

PERMANENT MAGNET AND METHOD OF MANUFACTURING SAME

This application is a national phase entry under 35 U.S.C. §371 of PCT Patent Application No. PCT/JP2007/74406, filed on Dec. 19, 2007, which claims priority under 35 U.S.C. §119 to Japanese Patent Application No. 2006-344781, filed Dec. 21, 2006, both of which are incorporated by reference.

TECHNICAL FIELD

The present invention relates to a permanent magnet and a method of manufacturing the permanent magnet, and more particularly relates to a permanent magnet having high magnetic properties in which Dy and/or Tb is diffused into grain boundary phase of a Nd—Fe—B based sintered magnet, and to a method of manufacturing the permanent magnet.

BACKGROUND ART

A Nd—Fe—B based sintered magnet (so-called neodymium magnet) is made of a combination of iron and elements of Nd and B that are inexpensive, abundant, and stably obtainable natural resources and can thus be manufactured at a low cost and additionally has high magnetic properties (its maximum energy product is about 10 times that of ferritic magnet). Accordingly, the Nd—Fe—B based sintered magnets have been used in various kinds of articles such as electronic devices and have recently come to be adopted in motors and electric generators for hybrid cars.

On the other hand, since the Curie temperature of the above-described sintered magnet is as low as about 300° C., there is a problem in that the Nd—Fe—B sintered magnet sometimes rises in temperature beyond a predetermined temperature depending on the circumstances of service of the product to be employed and therefore that it will be demagnetized by heat when heated beyond the predetermined temperature. In using the above-described sintered magnet in a desired product, there are cases where the sintered magnet must be fabricated into a predetermined shape. There is then another problem in that this fabrication gives rise to defects (cracks and the like) and strains to the grains of the sintered magnet, resulting in a remarkable deterioration in the magnetic properties.

Therefore, when the Nd—Fe—B sintered magnet is obtained, it is considered to add Dy and Tb which largely improve the grain magnetic anisotropy of principal phase because they have magnetic anisotropy of 4f-electron larger than that of Nd and because they have a negative Stevens factor similar to Nd. However, since Dy and Tb take a ferrimagnetism structure having a spin orientation negative to that of Nd in the crystal lattice of the principal phase, the strength of magnetic field, accordingly the maximum energy product exhibiting the magnetic properties is extremely reduced.

In order to solve this kind of problem, it has been proposed: to form a film of Dy and Tb to a predetermined thickness (to be formed in a film thickness of above 3 μm depending on the volume of the magnet) over the entire surface of the Nd—Fe—B sintered magnet; then to execute heat treatment at a predetermined temperature; and to thereby homogeneously diffuse the Dy and Tb that have been deposited (formed into thin film) on the surface into the grain boundary phase of the magnet (see non-patent document 1).

The permanent magnet manufactured in the above-described method has an advantage in that: because Dy and Tb diffused into the grain boundary phase improve the grain magnetic anisotropy of each of the grain surfaces, the nucleation type of coercive force generation mechanism is strengthened; as a result, the coercive force is dramatically improved; and the maximum energy product will hardly be lost (it is reported in non-patent document 1 that a magnet can be obtained having a performance, e.g., of the remanent flux density: 14.5 kG (1.45 T), maximum energy product: 50 MGOe (400 kJ/m$^3$), and coercive force: 23 kOe (3 MA/m)).

[Non-patent document 1] Improvement of coercivity on thin $Nd_2Fe_{14}B$ sintered permanent magnets (by Pak Kite of Tohoku University, Doctor Thesis, Mar. 23, 2000)

DISCLOSURE OF THE INVENTION

Problems to be Solved by the Invention

By the way, since a Nd—Fe—B based sintered magnet has rare-earth elements and iron as its chief composition, it is susceptible to oxidation when exposed to the atmosphere. In case the above-described processing of diffusion into the grain boundary phase is executed after Dy and/or Tb has been adhered to the surface of the sintered magnet in a state of oxidation on the surface of the sintered magnet, the diffusion of Dy and/or Tb into the grain boundary phase is hindered by the surface oxidation layer. As a result, there is a problem in that the diffusion processing cannot be performed in a short time and that the magnetic properties cannot be efficiently improved or recovered. As a solution, it is conceivable, prior to the adhesion of Dy and/or Tb to the surface of the sintered magnet, to clean the surface of the sintered magnet by plasma by using a plasma generating apparatus for generating Ar or He plasma of a known construction. This solution, however, will result in an increase in the manufacturing steps, thereby resulting in poor workability.

Therefore, in view of the above-described points, a first object of this invention is to provide a method of manufacturing a permanent magnet in which Dy and/or Tb adhered to the surface of the sintered magnet can be efficiently diffused into the grain boundary phase and in which a permanent magnet with high magnetic properties can be manufactured at high productivity. A second object of this invention is to provide a permanent magnet in which Dy and/or Tb is efficiently diffused only into the grain boundary phase of Nd—Fe—B based sintered magnet, the permanent magnet having high magnetic properties.

Means for Solving the Problems

In order to solve the above-described problems, the method of manufacturing a permanent magnet comprises: heating iron-boron-rare earth based sintered magnet disposed in a processing chamber to a predetermined temperature; evaporating an evaporating material disposed in a same or another processing chamber, the evaporating material comprising a hydride containing at least one of Dy and Tb; causing the evaporated evaporating material to be adhered to a surface of the sintered magnet; and diffusing metal atoms of Dy and/or Tb of the adhered evaporating material into a grain boundary phase of the sintered magnet.

According to this invention, evaporated evaporating material is supplied to the surface of the sintered magnet that has been heated to the predetermined temperature and gets adhered thereto. At that time, by heating the sintered magnet to the temperature at which the most appropriate diffusion velocity can be obtained, the metal atoms of Dy and/or Tb of the evaporating material adhered to the surface are gradually diffused into the grain boundary phase of the sintered magnet. In other words, the supply of the metal atoms of Dy and/or Tb to the surface of the sintered magnet and the diffusion thereof into the grain boundary phase of the sintered magnet are performed in a single processing (vacuum vapor processing).

In this case, as an evaporating material, there was used a hydride containing at least one of Dy and Tb. Therefore, when the evaporating material was caused to be evaporated, the dissociated hydrogen is supplied to the surface of the sintered magnet and reacts with the oxidized layer on the surface so as to be discharged as a compound such as $H_2O$. The oxidized layer on the surface of the sintered magnet can thus be removed and cleaned. As a result, the prior step of cleaning the surface of the sintered magnet becomes unnecessary prior to the supply of Dy and/or Tb to the surface of the sintered magnet, thereby improving the productivity. In addition, because the surface oxidized layer of the sintered magnet is removed, it becomes possible to efficiently diffuse and homogeneously spread Dy and/or Tb in a short period of time into the grain boundary phase of the sintered magnet, thereby further improving the productivity.

According to this configuration, there can be obtained a permanent magnet: in which the grain boundary phase has Dy-rich and/or Tb-rich phase (the phase containing Dy and/or Tb in the rage of 5~80%); in which Dy and/or Tb has been spread only near the surface of the grains; and which, consequently, has a high coercive force and high magnetic properties. In addition, in case there have occurred defects (cracks) in the grains near the surface of the sintered magnet at the time of fabrication thereof, Dy-rich and/or Tb-rich phase is formed on the inside of the cracks and, as a result, the magnetization intensity and the coercive force can be recovered.

At the time of the above-described processing, preferably the sintered magnet and the evaporating material are disposed at a distance from each other. Then, when the evaporating material is evaporated, the melted evaporating material can advantageously be prevented from getting adhered directly to the sintered magnet.

Preferably, the method further comprises: increasing or decreasing an amount of evaporation at a certain temperature by varying a specific surface area of the evaporating material disposed in the processing chamber, whereby an amount of supply of the evaporated evaporating material to the surface of the sintered magnet is adjusted. In this case, if an adjustment is made of the amount of supply of the evaporating material to the surface of the sintered magnet so that a thin film (layer), e.g., of the evaporating material is not formed, the surface conditions of the permanent magnet will be substantially the same as those before the above-described processing is executed. The surface of the permanent magnet manufactured is thus prevented from getting deteriorated (the surface roughness is prevented from getting poor). In addition, Dy and/or Tb can be restrained from getting excessively diffused into the grains particularly near the surface of the sintered magnet, and no particular post step is required, whereby higher productivity can be attained. In addition, the amount of supply, e.g., of the evaporating material to the surface of the sintered magnet can be easily adjusted without changing the configuration of the apparatus such as by providing a separate part inside the processing chamber in order to increase or decrease the amount of supply of the evaporating material to the surface of the sintered magnet.

If the method further comprises, after having diffused the metal atoms of Dy and/or Tb into the grain boundary phase of the sintered magnet, executing heat treatment to remove strains of the permanent magnet at a predetermined temperature lower than the said temperature, there can be obtained a permanent magnet of high magnetic properties in which the magnetization intensity and the coercive force can further be improved or recovered.

The method preferably further comprises, after having diffused metal atoms of Dy and/or Tb into the grain boundary phase of the sintered magnet, cutting the sintered magnet into a predetermined thickness in a direction perpendicular to the magnetic alignment direction. According to this configuration, as compared with the case in which: a sintered magnet of block form having predetermined dimensions is cut into a plurality of thin pieces; are then disposed in this state in the processing chamber; and are thereafter subjected to the above-described vacuum vapor processing, the taking into, and out of, the processing chamber of the sintered magnet can be performed in a shorter time and the prior preparations for performing the above-described vacuum vapor processing becomes easier, thereby improving the productivity.

In this case, if the sintered magnet is cut by a wire cutter and the like into the desired shape, there are cases where cracks occur in the grains which are the principal phase on the surface of the sintered magnet, whereby the magnetic properties are remarkably deteriorated. However, by executing the above-described vacuum vapor processing, since the grain boundary phase has Dy-rich phase and further since Dy is diffused only in the neighborhood of the grains, the magnetic properties can be prevented from getting deteriorated even if the permanent magnet is obtained by cutting the sintered magnet into a plurality of thin pieces in the post step. Combined with the fact that the finish machining is not necessary, there can be obtained a permanent magnet of high magnetic properties which is superior in productivity.

Furthermore, in order to solve the above problems, the permanent magnet according to claim 6 is characterized in: that an iron-boron-rare earth based sintered magnet disposed in a processing chamber is heated to a predetermined temperature; that an evaporating material disposed in a same or another processing chamber is heated to evaporate the evaporating material comprising a hydride containing at least one of Dy and Tb; that the evaporated evaporating material is caused to be adhered to a surface of the sintered magnet; and that metal atoms of Dy and/or Tb of the adhered evaporating material are diffused into a grain boundary phase of the sintered magnet.

Effects of the Invention

As described hereinabove, the method of manufacturing a permanent magnet according to this invention has an effect in that there can be obtained a permanent magnet in which, without the prior step of removing the oxidized layer on the surface of the sintered magnet, Dy and/or Tb can be efficiently diffused into the grain boundary phase, the permanent magnet having high productivity and high magnetic properties.

BEST MODE FOR CARRYING OUT THE INVENTION

With reference to FIGS. 1 and 2, a permanent magnet M of the present invention is manufactured by simultaneously executing a series of processes (vacuum vapor processing) of: evaporating an evaporating material v containing at least one of Dy and Tb; causing the evaporated material v to be adhered to a surface of a Nd—Fe—B based sintered magnet S that has been fabricated to a predetermined shape; and diffusing metal atoms of Dy and/or Tb of the adhered evaporating material into the grain boundary phase homogeneously and penetrated.

The Nd—Fe—B sintered magnet S as a starting material is manufactured as follows by a known method. That is, Fe, B, Nd are formulated at a predetermined ratio of composition to first manufacture an alloy of 0.05 mm~0.5 mm by the known strip casting method. Alternatively, an alloy having a thickness of about 5 mm may be manufactured by the known centrifugal casting method. A small amount of Cu, Zr, Dy, Tb, Al or Ga may be added therein during the formulation. Then, the manufactured alloy is once ground by the known hydrogen grinding process and subsequently finely ground by the jet-mill fine grinding process, thereby obtaining alloy raw meal powder. Subsequently, by the known compression-molding machine, the alloy raw meal powder is oriented in the magnetic field (magnetically aligned) and is molded in a metallic mold into a predetermined shape such as a rectangular parallelepiped, column, and the like and, thereafter, is sintered under given conditions to manufacture the above-described sintered magnet.

In compression-molding the alloy raw meal powder, in case the known lubricant is added to the alloy raw meal powder, it is preferable to optimize the conditions in each of the steps of manufacturing the sintered magnet S so that the mean grain diameter of the sintered magnet S falls within the range of 4 μm~8 μm. According to this configuration, without being influenced by the residual carbon in the sintered magnet S, Dy and/or Tb adhered to the surface of the sintered magnet can be efficiently diffused into the grain boundary phase, thereby attaining high productivity.

In this case, if the mean grain diameter is smaller than 4 μm, a permanent magnet having a high coercive force can be obtained due to the diffusion of Dy and/or Tb into the grain boundary phase. However, this will diminish the advantage of adding the lubricant to the alloy raw meal powder, the advantage being in that the flowability can be secured during compression molding in the magnetic field and the orientation can be improved. The orientation of the sintered magnet will become poor and, as a result, the remanent flux density and maximum energy product exhibiting the magnetic properties will be lowered. On the other hand, if the mean grain diameter is larger than 8 μm, the coercive force will be lowered because the crystal is large. In addition, since the surface area of the grain boundary becomes smaller, the ratio of concentration of the residual carbon near the grain boundary becomes large and the coercive force becomes largely lowered. Further, the residual carbon reacts with Dy and/or Tb, and the diffusion of Dy into the grain boundary phase is impeded and the time of diffusion becomes longer, resulting in poor productivity.

As shown in FIG. 2, a vacuum vapor processing apparatus 1 for executing the above-described processing has a vacuum chamber 12 in which a pressure can be reduced to, and kept at, a predetermined pressure (e.g., $1\times10^{-5}$ Pa) through an evacuating means 11 such as turbo-molecular pump, cryopump, diffusion pump, and the like. There is disposed in the vacuum chamber 12 a box body 2 comprising: a rectangular parallelopiped box part 21 with an upper surface being open; and a lid part 22 which is detachably mounted on the open upper surface of the box part 21.

A downwardly bent flange 22*a* is formed along the entire circumference of the lid part 22. When the lid part 22 is mounted in position on the upper surface of the box part 21, the flange 22*a* is fitted into the outer wall of the box part 21 (in this case, no vacuum seal such as a metal seal is provided), so as to define a processing chamber 20 which is isolated from the vacuum chamber 12. It is so configured that, when the vacuum chamber 12 is reduced in pressure through the evacuating means 11 to a predetermined pressure (e.g., $1\times10^{-5}$ Pa), the processing chamber 20 is reduced in pressure to a pressure (e.g., $5\times10^{-4}$ Pa) that is higher substantially by half a digit than that in the vacuum chamber 12.

The volume of the processing chamber 20 is set, taking into consideration the mean free path of the evaporating material v, such that the metal atoms in the vapor atmosphere can be supplied to the sintered magnet S directly or from a plurality of directions by repeating collisions. The surfaces of the box part 21 and the lid part 22 are set to have thicknesses not to be thermally deformed when heated by a heating means to be described hereinafter, and are made of a material that does not react with the evaporating material v.

In other words, when the evaporating material v is Dy, in case $Al_2O_3$ which is often used in an ordinary vacuum apparatus is used, there is a possibility that Dy in the vapor atmosphere reacts with $Al_2O_3$, to form a reaction product on the surface thereof, resulting in penetration of the Al atoms into the vapor atmosphere. Accordingly, the box body 2 is made, e.g., of Mo, W, V, Ta or alloys of them (including rare earth elements added Mo alloy, Ti added Mo alloy, and the like), CaO, $Y_2O_3$ or oxides of rare earth elements, or constituted by forming an inner lining on the surface of another insulating material. A bearing grid 21*a* of, e.g., a plurality of Mo wires (e.g., 0.1~10 mm (dia.)) is arranged in lattice at a predetermined height from the bottom surface in the processing chamber 20. On this bearing grid 21*a* a plurality of sintered magnets S can be placed side by side. On the other hand, the evaporating material v is appropriately placed on a bottom surface, side surfaces or a top surface of the processing chamber 20.

As the evaporating material v, there is used a hydride containing at least one of Dy and Tb which largely improves the magnetocrystalline anisotropy of the principal phase, e.g., $DyH_2$ or $TbH_2$ manufactured in a known method. According to this configuration, even in a state in which the surface of the sintered magnet S is oxidized, once the evaporating material v is evaporated at the time of vacuum vapor processing, dissociated hydrogen is supplied to the surface of the sintered magnet S and react with the surface oxygen layer, thereby being discharged as a compound such as $H_2O$. The oxidized layer on the surface of the sintered magnet S is thus removed and cleaned. As a result, a preparatory step of cleaning the surface of the sintered magnet S prior to supply of Dy and/or Tb to the surface of the sintered magnet S is not required any more, thereby improving the productivity. In addition, since the oxidized layer on the surface of the sintered magnet S is removed, Dy and/or Tb can be efficiently and homogeneously diffused into the grain boundary phase of the sintered magnet S, thereby further improving the productivity.

The vacuum chamber 12 is provided with a heating means 3. The heating means 3, like the box body 2, is made of a material that does not react with the evaporating material v, and is arranged so as to enclose the circumference of the box body 2. The heating means 3 comprises: a thermal insulating material of Mo make which is provided with a reflecting surface on the inner surface thereof; and an electric heater which is disposed on the inside of the thermal insulating material and which has a filament of Mo make. By heating the box body 2 by the heating means 3 at a reduced pressure, the processing chamber 20 is indirectly heated through the box body 2, whereby the inside of the processing chamber 20 can be heated substantially uniformly.

A description will now be made of the manufacturing of a permanent magnet M using the above-described vacuum vapor processing apparatus 1. First of all, sintered magnets S made in accordance with the above-described method are placed on the bearing grid 21*a* of the box part 21, and $DyH_2$ as the evaporating material v is placed on the bottom surface of the box part 21 (according to this, the sintered magnets S and the evaporating material v are disposed at a distance from each other in the processing chamber 20). After having mounted in position the lid part 22 on the open upper surface of the box part 21, the box body 2 is placed in a predetermined position enclosed by the heating means 3 in the vacuum chamber 12 (see FIG. 2). Then through the evacuating means 11 the vacuum chamber 12 is evacuated until it reaches a predetermined pressure (e.g., $1\times10^{-4}$ Pa) (the processing chamber 20 is evacuated to a pressure substantially half-digit higher than the above) and the processing chamber 20 is heated by actuating the heating means 3 when the vacuum chamber 12 has reached the predetermined pressure. In this case, since the sintered magnet S itself is heated to a predetermined temperature (e.g., 800° C.), the stains, gas and moisture content adsorbed on the surface of the sintered magnet will be removed.

When the temperature in the processing chamber 20 has reached a predetermined temperature, $DyH_2$ disposed on the bottom surface of the processing chamber 20 is heated to substantially the same temperature as the processing chamber 20 and starts evaporation. A vapor atmosphere will thus be formed in the processing chamber 20. Even if $DyH_2$ starts evaporation, since the sintered magnet S and $DyH_2$ are disposed at a distance from each other, there is no possibility that $DyH_2$ directly gets adhered to the sintered magnet whose Nd-rich layer on the surface is melted. In addition, since the processing chamber 20 has been heated to a temperature above the predetermined temperature (800° C.), hydrogen will be dissociated from the evaporated $DyH_2$ and the Dy atoms and hydrogen in the vapor atmosphere are supplied toward, and adhered to, the surface of the sintered magnet S that has been heated to substantially the same temperature as Dy, from a plurality of directions either directly or by repeating collisions.

In this case, the dissociated hydrogen is supplied to the surface of the sintered magnet S to thereby react with the surface oxidation layer, and is then discharged as compounds such as $H_2O$ and the like through the clearance between the box part 21 and the lid part 22 into the vacuum chamber 12. In this manner, cleaning is executed by removing the surface oxidation layer of the sintered magnet S and, at the same time, metal atoms of Dy get adhered to the surface of the sintered magnet. Then, Dy adhered to the surface of the sintered magnet S that has been heated to substantially the same temperature as the processing chamber 20 is diffused into the grain boundary phase of the sintered magnet S, whereby a permanent magnet M can be obtained.

As shown in FIG. 3, when the evaporating material v in the vapor atmosphere is supplied to the surface of the sintered magnet S so as to form a layer (e.g., a thin film of Dy layer) L1 made of the evaporating material v, the surface of the permanent magnet M will be remarkably deteriorated (surface roughness becomes worsened) as a result of recrystallization of the evaporating material v that has been adhered to, and deposited on, the surface of the sintered magnet S. In addition, the evaporating material v adhered to, and deposited on, the surface of the sintered magnet S that has been heated to substantially the same temperature during processing gets melted and Dy will be excessively diffused into the grains in a region R1 near the surface of the sintered magnet S. As a result, the magnetic properties cannot be effectively improved or recovered.

That is, once a thin film made of the evaporating material v is formed on the surface of the sintered magnet S, the average composition on the surface of the sintered magnet S adjoining the thin film becomes Dy-rich composition. Once the composition becomes Dy-rich composition, the liquid phase temperature lowers and the surface of the sintered magnet S gets melted (i.e., the principal phase is melted and the amount of liquid phase increases). As a result, the region near the surface of the sintered magnet S is melted and collapsed and thus the asperities increase. In addition, Dy excessively penetrates into the grains together with a large amount of liquid phase and thus the maximum energy product and the remanent flux density exhibiting the magnetic properties are further lowered.

According to this embodiment, $DyH_2$ in bulk form (substantially spherical shape) having a small surface area per unit volume (specific surface area) or $DyH_2$ in powder form was disposed on the bottom surface of the processing chamber 20 in a ratio of 1~10% by weight of the sintered magnet so as to reduce the amount of evaporation at a constant temperature. In addition, when the evaporating material v is $DyH_2$, the temperature in the processing chamber 20 was set to a range of 800° C.~1050° C., preferably 900° C.~1000° C., by controlling the heating means 3.

If the temperature in the processing chamber 20 (accordingly the heating temperature of the sintered magnet 5) is below 800° C., the velocity of diffusion of Dy atoms adhered to the surface of the sintered magnet S into the grain boundary phase is retarded. It is thus impossible to make the Dy atoms to be diffused and homogeneously penetrated into the grain boundary phase of the sintered magnet before the thin film is formed on the surface of sintered magnet S. On the other hand, at the temperature above 1050° C., the vapor pressure increases and thus the evaporating material v in the vapor atmosphere are excessively supplied to the surface of the sintered magnet S. In addition, there is a possibility that Dy would be diffused into the grains. Should Dy be diffused into the grains, the magnetization intensity in the grains is greatly reduced and, therefore, the maximum energy product and the remanent flux density are further reduced.

In order to diffuse Dy into the grain boundary phase before the thin film made up of the evaporating material v is formed on the surface of the sintered magnet S, the ratio of a total surface area of the sintered magnet S disposed on the bearing grid 21*a* in the processing chamber 20 to a total surface area of the evaporating material v in bulk form disposed on the bottom surface of the processing chamber 20 is set to fall in a range of $1\times10^{-4}$~$2\times10^{3}$. In a ratio other than the range of $1\times10^{-4}$~$2\times10^{3}$, there are cases where a thin film of Dy and/or Tb is formed on the surface of the sintered magnet S and thus a permanent magnet having high magnetic properties cannot be obtained. In this case, the above-described ratio shall preferably fall within a range of $1\times10^{-3}$ to $1\times10^{3}$, and the above-described ratio of $1\times10^{-2}$ to $1\times10^{2}$ is more preferable.

According to the above configuration, by lowering the vapor pressure and also by reducing the amount of evaporation of the evaporating material v, the amount of supply of the evaporating material v to the sintered magnet S is restrained. In addition, as a combined effect of heating the sintered magnet S at a predetermined temperature range and removing the oxidization layer on the surface of the sintered magnet S, the velocity of diffusion is accelerated. The Dy atoms of the evaporating material v deposited on the surface of the sintered magnet S can be efficiently and homogeneously diffused and penetrated into the grain boundary phase of the sintered magnet S before the layer made of the evaporating material v is formed by deposition on the surface of the sintered magnet S (see FIG. 1). As a result, the permanent magnet M can be prevented from deteriorating on the surface thereof, and Dy can be restrained from being excessively diffused into the grain boundary near the surface of the sintered magnet. In this manner, by having a Dy-rich phase (a phase containing Dy in the range of 5~80%) in the grain boundary phase and by diffusing Dy only in the neighborhood of the surface of the grains, the magnetization intensity and coercive force are effectively improved. In addition, there can be obtained a permanent magnet M that requires no finishing work and that is superior in productivity.

As shown in FIG. 4, when the sintered magnet is worked into a desired configuration by a wire cutter, and the like, after having manufactured the above-described sintered magnet, there are cases where cracks occur in the grains which are the principal phase on the surface of the sintered magnet, resulting in a remarkable deterioration in the magnetic properties (see FIG. 4(*a*)). However, by executing the above-described vacuum vapor processing, there will be formed a Dy-rich phase on the inside of the cracks of the grains near the surface (see FIG. 4(*b*)), whereby the magnetization intensity and coercive force are recovered. On the other hand, by executing the above-described vacuum vapor processing, the grain boundary phase has the Dy-rich phase and further Dy gets diffused only near the surface of the grains. Therefore, even if a permanent magnet M is obtained by cutting the sintered magnet in block form, after having executed the above-described vacuum vapor processing, into a plurality of sliced thin pieces by means of a wire cutter and the like as a post step, the magnetic properties of the permanent magnet get hardly deteriorated. As compared with a case in which: a sintered magnet of block form having predetermined dimensions is cut into a plurality of thin pieces; the thin pieces are then contained as they are by disposing them in position on the bearing grid 21*a* inside the box body 2; and they are then subjected to the above-described vacuum vapor processing, it is possible, for example, to perform at a shorter time the putting and taking the sintered magnet S into, and out of, the box body 2. The preparatory work for executing the above-described vacuum vapor processing becomes easier, and the preparatory step and the finishing work is not required. As a combined effect of the above, a high productivity can be attained.

Finally, after having executed the above-described processing for a predetermined period of time (e.g., 1~72 hours), the operation of the heating means 3 is stopped, Ar gas of 10 KPa is introduced into the processing chamber 20 through a gas introducing means (not illustrated), evaporation of the evaporating material v is stopped, and the temperature in the processing chamber 20 is once lowered to, e.g., 500° C. Continuously the heating means 3 is actuated once again and the temperature in the processing chamber 20 is set to a range of 450° C.~650° C., and heat treatment for removing the strains in the permanent magnets is executed to further improve or recover the coercive force. Finally, the processing chamber 20 is rapidly cooled substantially to room temperature and the box body 2 is taken out of the vacuum chamber 12.

In the embodiment of the present invention, a description has been made of an example in which $DyH_2$ is used as the evaporating material v. However, within a heating temperature range (a range of 900° C.~1000° C.) of the sintered magnet S that can accelerate the diffusion velocity, hydrides containing Tb whose vapor pressure is low, e.g., $TbH_2$ can be used. Or else, hydrides containing Dy and Tb may also be used. It was so arranged that an evaporating material v in bulk form or in powder form having a small specific surface area was used in order to reduce the amount of evaporation at a certain temperature. However, without being limited thereto, it may be so arranged that a pan having a recessed shape in cross section is disposed inside the box part 21 to contain in the pan the evaporating material v in granular form or bulk form, thereby reducing the specific surface area. In addition, after having disposed the evaporating material v in the pan, a lid (not illustrated) having a plurality of openings may be mounted.

In the embodiment of the present invention, a description has been made of an example in which the sintered magnet S and the evaporating material v were disposed in the processing chamber 20. However, in order to enable to heat the sintered magnet S and the evaporating material v at different temperatures, an evaporating chamber (another processing chamber, not illustrated) may be provided inside the vacuum chamber 12, aside from the processing chamber 20, and another heating means may be provided for heating the evaporating chamber. After having evaporated the evaporating material v inside the evaporating chamber, the evaporating material v in the vapor atmosphere may be arranged to be supplied to the sintered magnet inside the processing chamber 20 through a communicating passage which communicates the processing chamber 20 and the evaporating chamber together.

In this case, in case the evaporating material v is $DyH_2$, the evaporating chamber may be heated at a range of 700° C.~1050° C. At a temperature below 700° C., there cannot reach a vapor pressure at which the evaporating material v can be supplied to the surface of the sintered magnet S so that Dy can be diffused and homogeneously penetrated into the grain boundary phase. On the other hand, in case the evaporating material v is $TbH_2$, the evaporating chamber may be heated to a range of 900° C.~1150° C. At a temperature below 900° C., there cannot reach a vapor pressure at which Tb atoms can be supplied to the surface of the sintered magnet S. On the other hand, at a temperature above 1150° C., Tb gets diffused into the grains and thus the maximum energy product and the remanent flux density will be lowered.

Further in the embodiment of the present invention, a description has been made of an example in which the box body 2 was constituted by mounting the lid part 22 on an upper surface of the box part 21. However, if the processing chamber 20 is isolated from the vacuum chamber 12 and can be reduced in pressure accompanied by the pressure reduction in the vacuum chamber 12, it is not necessary to limit to the above example. For example, after having disposed the sintered magnet S inside the box part 21, the upper opening thereof may be covered by a foil of Mo make. On the other hand, it may be so constructed that the processing chamber 20 can be hermetically closed inside the vacuum chamber 12 so as to be maintained at a predetermined pressure independent of the vacuum chamber 12.

As the sintered magnet S, the smaller is the amount of oxygen content, the larger becomes the velocity of diffusion of Dy and/or Tb into the grain particle phase. Therefore, the oxygen content of the sintered magnet S itself may be below 3000 ppm, preferably below 2000 ppm, and most preferably below 1000 ppm.

EXAMPLE 1

As a Nd—Fe—B based sintered magnet, there was used one whose composition was 29Nd-3Dy-1B-2Co-0.1Cu-bal.Fe and was fabricated into a rectangular parallelepiped of 20×10×5 mm. In this case, after finishing the surface of the sintered magnet S so as to have a surface roughness of below 10 μm, cleaning was made using acetone.

Then, by using the above-described vacuum vapor processing apparatus 1, there was obtained a permanent magnet M by the above-described vacuum vapor processing. In this case, 60 sintered magnets S were disposed at an equal distance from one another on a bearing grind 21*a* inside the box body 2 of Mo make. In addition, as the evaporating material, there was used $DyH_2$ (manufactured by Wako Junyaku Kabushiki Kaisha) and $TbH_2$ (manufactured by Wako Junyaku Kabushiki Kaisha) and was disposed in a total amount of 100g on the bottom surface of processing chamber 20. Then, by actuating the evacuating means, the vacuum chamber was once reduced in pressure to $1\times10^{-4}$ (the pressure in the processing chamber was $5\times10^{-3}$), and the heating temperature by the heating means 3 of the processing chamber 20 was set to 850° C. (Example 1*a*) in the case of $DyH_2$ and was set to 1000° C. (Example 1*b*) in the case of $TbH_2$. Then, when the temperature in the processing chamber 20 has reached 950° C., the above-described vacuum vapor processing was executed in this state for 1.8 or 18 hours. Subsequently, heat treatment was executed to remove the strains in the permanent magnet. In this case, the heat treatment temperature was set to 550° C., and the processing time was set to 60 minutes. Finally, the permanent magnet obtained by executing the above method was fabricated by wire cutting into a shape of 10×5 mm (dia.).

FIGS. 5 and 6 are tables showing average values of magnetic properties when permanent magnets were obtained by the above-described vacuum vapor processing by using Dy of 99.9% purity in bulk form as the evaporating material (Comparative Example 1*a*) and by using Tb of 99.9% purity in bulk form as the evaporating material (Comparative Example 1*b*), in comparison with average values of magnetic properties when permanent magnets were obtained by the vacuum vapor processing under the same conditions as in the above Example 1*a* and Example 1*b*. According to these tables, in the case of the evaporating material containing therein Dy in the Comparative Example 1*a* in which Dy was used as the evaporating material, as the time of vacuum vapor processing (time of diffusion) becomes longer, the larger becomes the coercive force. When the time of vacuum processing was set to 18 hours, there was obtained a high coercive force of 24.3 kOe. On the other hand, in the Example 1*a*, it can be seen that high coercive force of 24.3 kOe was obtained in less than half the vacuum evaporating processing time (8 hours), thereby efficiently diffusing Dy (see FIG. 5).

In addition, in the Comparative Example 1*b* in which Tb was used as the evaporating material v, the longer becomes the vacuum vapor processing time (time of diffusion), the larger becomes the coercive force. When the vacuum vapor processing time was set to 18 hours, a high coercive force of 28.3 kOe was obtained. On the other hand, in Example 1*b*, it can be seen that a high coercive force of 28.2 kOe was obtained at less than half the vacuum vapor processing time (8 hours), thereby efficiently diffusing Tb (see FIG. 6).

BRIEF DESCRIPTION OF THE DRAWINGS

FIG. 5 is a table showing magnetic properties of the permanent magnet manufactured in accordance with Example 1*a*; and FIG. 6 is a table showing magnetic properties of the permanent magnet manufactured in accordance with Example 1*b*.

DESCRIPTION OF REFERENCE NUMERALS AND CHARACTERS

Figure 1:
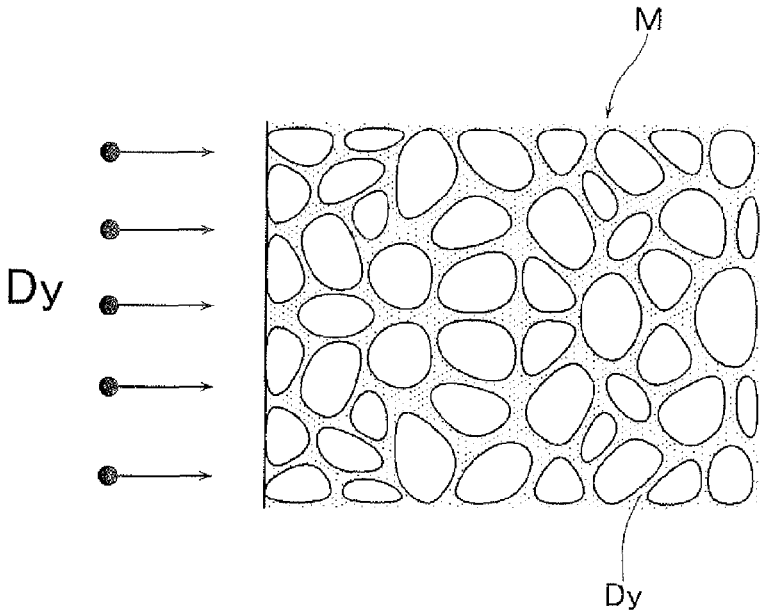
FIG. 1 is a schematic explanatory view of a cross-section of the permanent magnet manufactured in accordance with this invention.
Figure 2:
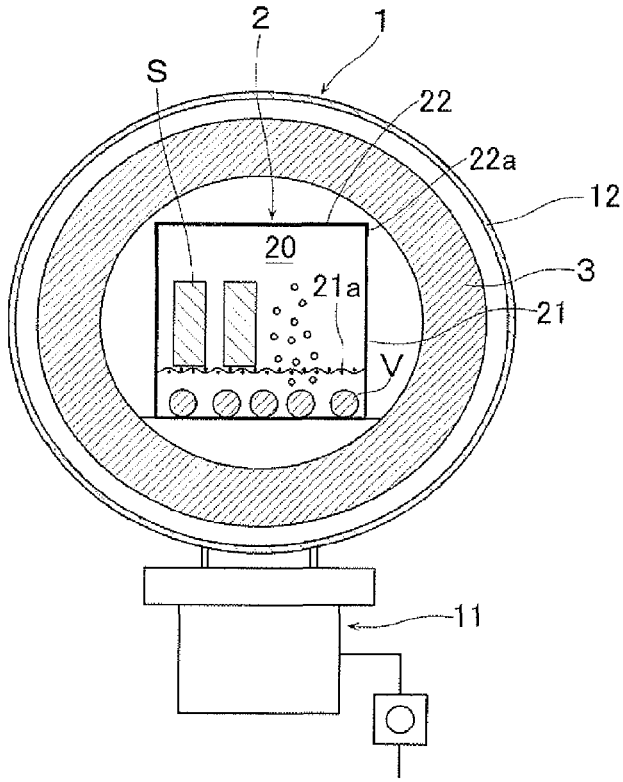
FIG. 2 is a schematic view of the vacuum processing apparatus for executing the processing of this invention.
Figure 3:
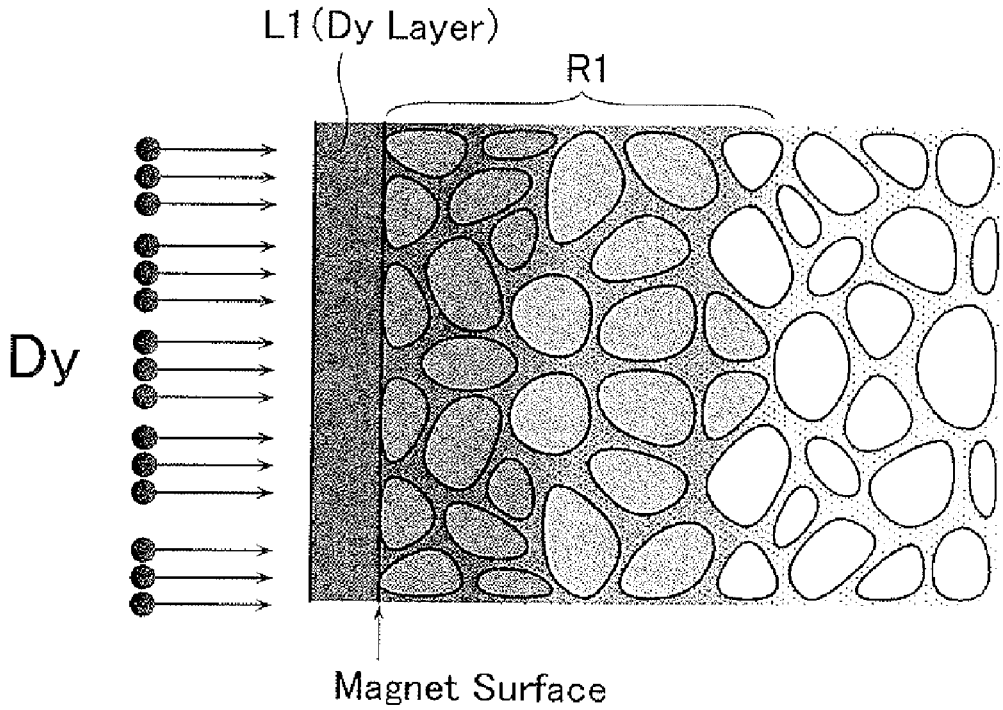
FIG. 3 is a schematic explanatory view of a cross-section of a permanent magnet manufactured in accordance with a prior art.
Figure 4A:
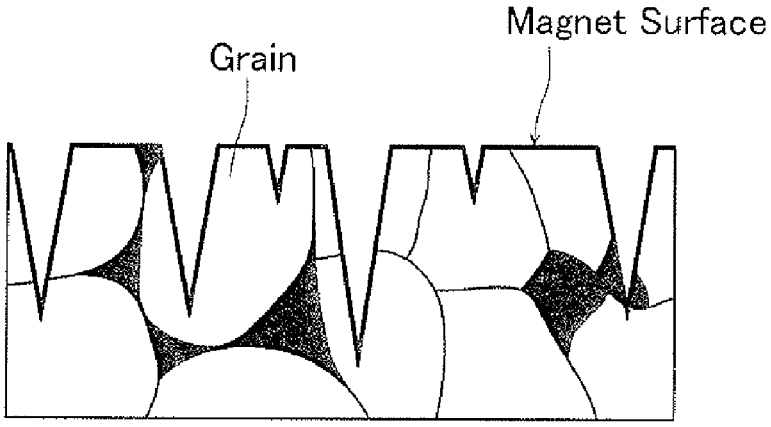
FIG. 4 (*a*) is an explanatory view showing deterioration of the surface of the sintered magnet caused by machining, and FIG. 4 (*b*) is an explanatory view showing the surface condition of a permanent magnet manufactured in accordance with this invention.
Figure 4B:
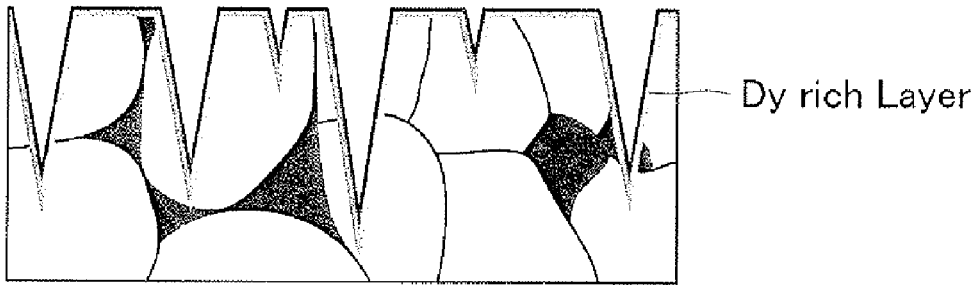

1 vacuum vapor processing apparatus
12 vacuum chamber
20 processing chamber
2 box body
21 box part
22 lid part
3 heating means
S sintered magnet
M permanent magnet
V evaporating material

What is claimed is:

1. A method of manufacturing a permanent magnet comprising:

heating an iron-boron-rare earth based sintered magnet disposed in a processing chamber to a first predetermined temperature which is from 800° C. to 1050° C.;

evaporating an evaporating material disposed in the processing chamber or another processing chamber, the evaporating material comprising a hydride containing at least one of Dy and Tb;

causing the evaporated evaporating material to be adhered to a surface of the sintered magnet; and diffusing metal atoms of the at least one of Dy and Tb of the adhered evaporating material into a grain boundary phase of the sintered magnet, before a thin film made of the evaporated material is formed on the surface of the sintered magnet, wherein the evaporating and the diffusing are executed substantially simultaneously.

2. The method of manufacturing a permanent magnet according to claim 1, wherein the sintered magnet and the evaporating material are disposed at a distance from each other.

3. The method of manufacturing a permanent magnet according to claim 1, further comprising:

increasing or decreasing an amount of evaporation at a certain temperature by varying a specific surface area of the evaporating material disposed in the processing chamber or the another processing chamber, whereby an amount of supply of the evaporated evaporating material to the surface of the sintered magnet is adjusted.

4. The method of manufacturing a permanent magnet according to claim 1, further comprising, after having diffused the metal atoms of the at least one of Dy and Tb into the grain boundary phase of the sintered magnet, executing a heat treatment to remove strains of the permanent magnet at a second predetermined temperature lower than the said first predetermined temperature.

5. The method of manufacturing a permanent magnet according to claim 1, further comprising, after having diffused metal atoms of the at least one of Dy and Tb into the grain boundary phase of the sintered magnet, cutting the sintered magnet into a predetermined thickness in a direction perpendicular to a magnetic alignment direction.

6. The method of manufacturing a permanent magnet according to claim 2, further comprising:

increasing or decreasing an amount of evaporation at a certain temperature by varying a specific surface area of the evaporating material disposed in the processing chamber or the another processing chamber, whereby an amount of supply of the evaporated evaporating material to the surface of the sintered magnet is adjusted.

7. The method of manufacturing a permanent magnet according to claim 2, further comprising, after having diffused the metal atoms of the at least one of Dy and Tb into the grain boundary phase of the sintered magnet, executing a heat treatment to remove strains of the permanent magnet at a second predetermined temperature lower than the said first predetermined temperature.

8. The method of manufacturing a permanent magnet according to claim 2, further comprising, after having diffused metal atoms of the at least one of Dy and Tb into the grain boundary phase of the sintered magnet, cutting the sintered magnet into a predetermined thickness in a direction perpendicular to a magnetic alignment direction.

* * * * *